US005303483A

United States Patent [19]

Chan

[11] Patent Number: 5,303,483

[45] Date of Patent: Apr. 19, 1994

[54] AIR DIFFUSERS

[75] Inventor: Wing-Kin Chan, Kowloon, Hong Kong

[73] Assignee: China Pacific Trade Limited, British Virgin Isls.

[21] Appl. No.: 727,912

[22] Filed: Jul. 10, 1991

[30] Foreign Application Priority Data

Jul. 24, 1990 [GB] United Kingdom ..... 9016236

[51] Int. Cl.[5] ..... A45D 20/00

[52] U.S. Cl. ..... 34/97; 392/380; 392/383

[58] Field of Search ..... 34/96, 97, 98, 99, 243 R; 392/360, 379, 380, 381, 370, 371, 363, 382-385

[56] References Cited

U.S. PATENT DOCUMENTS

| | | | |
|---|---|---|---|
| 3,837,581 | 9/1974 | Orsoff | 34/97 |
| 4,287,673 | 9/1981 | Wolter | 34/97 |
| 4,295,283 | 10/1981 | Tomaro | 34/97 |
| 4,602,146 | 7/1986 | Barns et al. | 34/96 |
| 4,759,135 | 7/1988 | Scivoletto | 34/97 |
| 4,827,105 | 5/1989 | Brown, Jr. | 34/97 |
| 4,848,007 | 7/1989 | Montagnino | 34/97 |
| 4,896,020 | 1/1990 | Poweleit | 34/97 |
| 5,036,601 | 8/1991 | Mulle, Jr. et al. | 34/97 |

*Primary Examiner*—Henry A. Bennett
*Assistant Examiner*—Denise L. Gromada
*Attorney, Agent, or Firm*—Burns, Doane, Swecker and Mathis

[57] ABSTRACT

An air diffuser for attachment to a handheld hairdryer includes a diffuser neck and an angled diffuser head. The diffuser neck is provided with air vents. If a back pressure builds up in the diffuser with a consequent risk of overheating the hairdryer, then air escapes through the vents relieving the back pressure. In the absence of a back pressure substantially all of the air flows along the diffuser and out through the mouth of the diffuser.

4 Claims, 4 Drawing Sheets

FIG 4
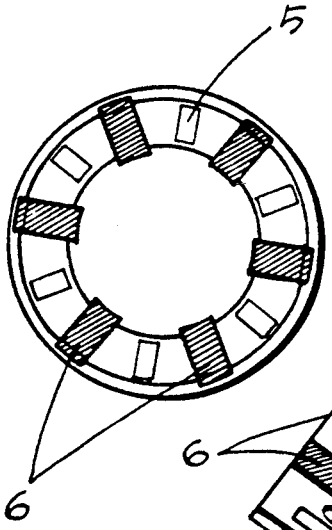
FIG 5
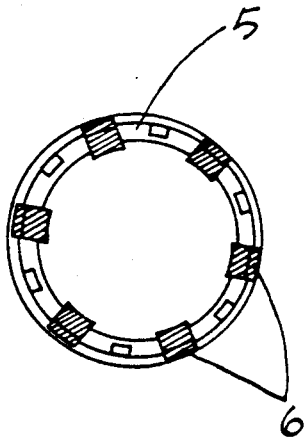
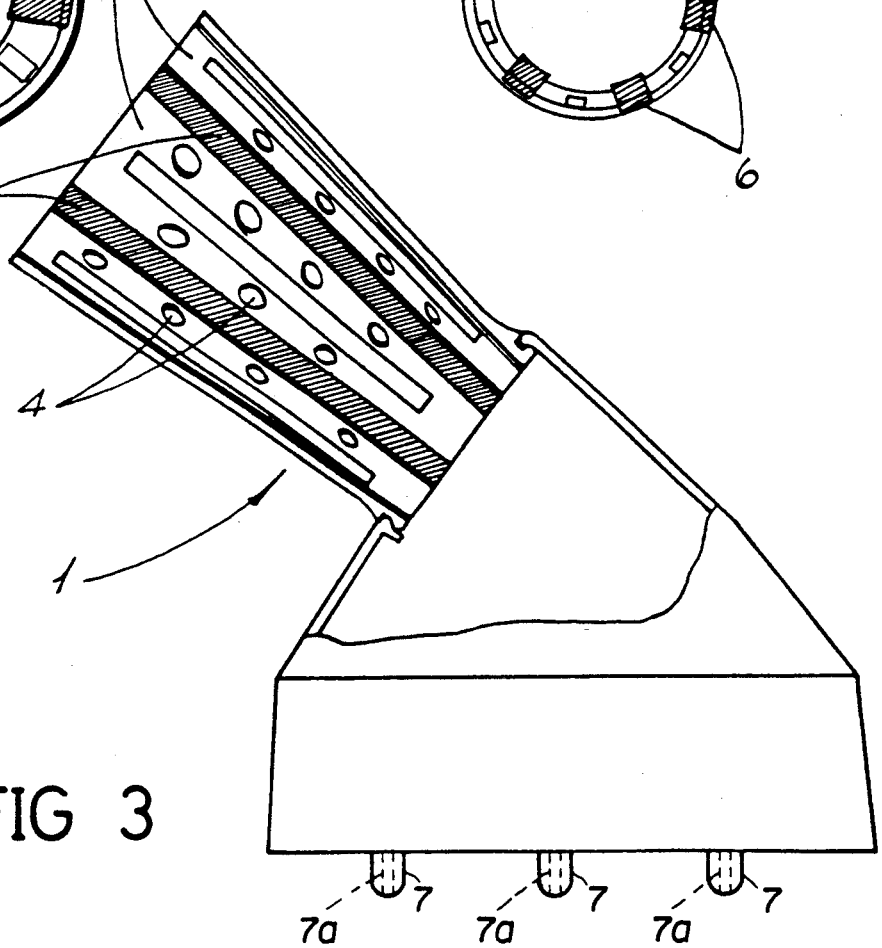
FIG 3

AIR DIFFUSERS

BACKGROUND AND SUMMARY

The present invention relates to air diffusers for hairdryers.

Handheld warm air hairdryers generally produce a narrow stream of warm air. If it is desired to produce a more even distribution of the warm air, then an air diffuser may be fitted to the barrel of the hairdryer for this purpose.

Most conventional air diffusers suffer from the disadvantage that they are awkward to use. In particular, the combined hairdryer and diffuser is substantially longer than the hairdryer alone and is difficult to manipulate especially when drying hair on the crown of the head or hair at the back of the head.

A diffuser which attempts to overcome the above problem consists of a diffuser neck and diffuser head, the diffuser neck being attachable co-axially to the barrel of the hairdryer, and the diffuser head being at an angle to the diffuser neck. This diffuser is much easier to manipulate. In particular, when drying for example hair on the crown of the head, the user can hold the hairdryer to one side of his head, and is not obliged to stretch his arms up to directly above the crown of his head.

However, the diffuser with the angled head is inefficient, the inefficiency arising as follows. Air from the hairdryer is driven along the diffuser neck, enters the angled diffuser head, and is then deflected by the internal surface of the diffuser head out through the diffuser mouth. The long path which the air travels, together with the deflection of the air in the diffuser head and consequent turbulence, gives rise to a risk of back pressure and overheating in the hairdryer. To overcome this problem, a number of vents are provided in the diffuser head, so that a proportion of the air driven along the neck flows directly out through the vents, thus reducing the possibility of back pressure. This proportion of heated air is therefore wasted.

An object of the present invention is to provide an air diffuser which is easy to manipulate and efficient in operation.

The present invention provides an air diffuser for attachment to a handheld hairdryer, comprising a diffuser neck, an angled diffuser head, and air vents to prevent back pressure and overheating, characterized in that the air vents are provided in the diffuser neck.

As hair is driven along the diffuser neck, if no back pressure builds up then substantially all of the air flows to the diffuser head and out through the diffuser mouth to dry the hair. However, if a back pressure builds up this will cause air to be vented through the air vents in the neck, thereby eliminating the risk o overheating. The air vents therefore come into play only as required.

BRIEF DESCRIPTION OF THE DRAWINGS

The invention will now be described more particularly with reference to the accompanying drawings which show, by way of example only, a number of different constructions of air diffuser according to the invention. In each case the air diffuser comprises an assembly consisting of an angled diffuser head and a diffuser neck for for connection between the diffuser head and the hairdryer barrel. In the drawings:

FIGS. 1 to 5 are various views of a first construction, showing the diffuser head and a pair of alternative diffuser necks which allow the diffuser head to be connected to a range of different hairdryers;

DETAILED DESCRIPTION AND PREFFERED EMBODIMENT

Figure 1:
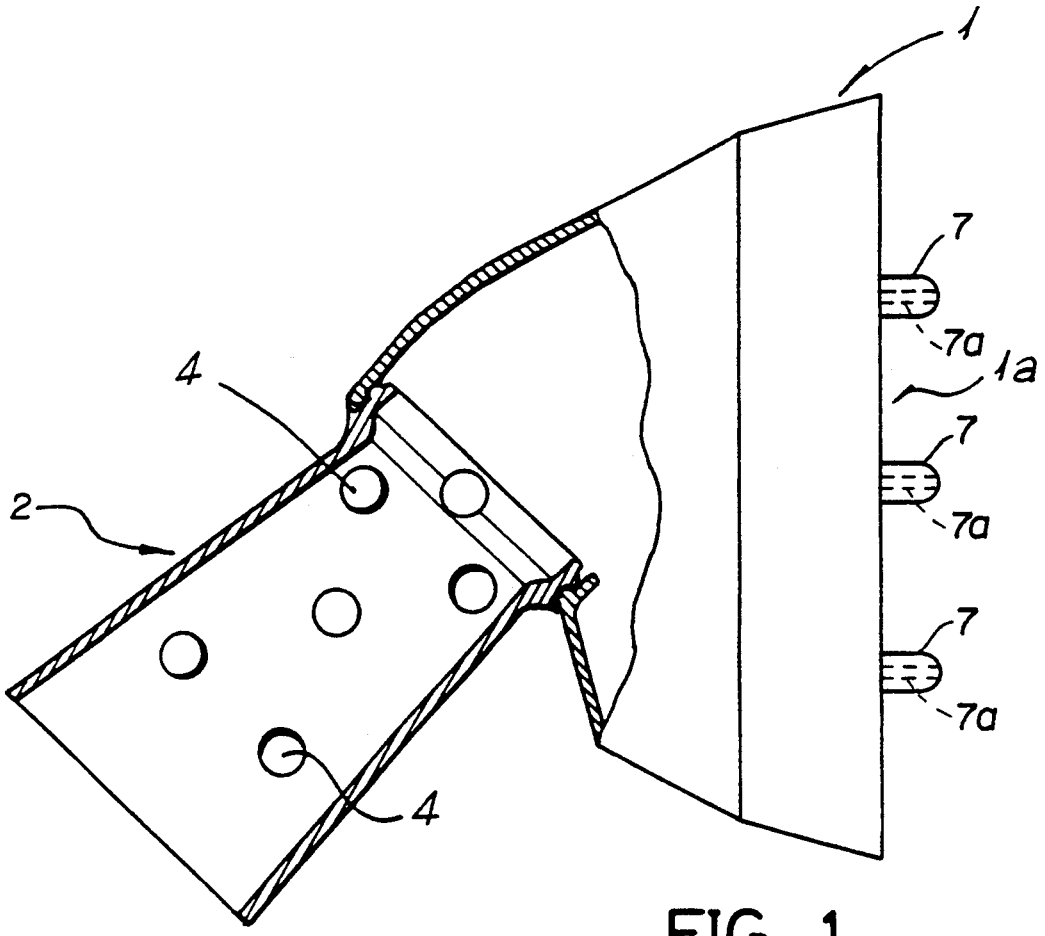
Figure 2:
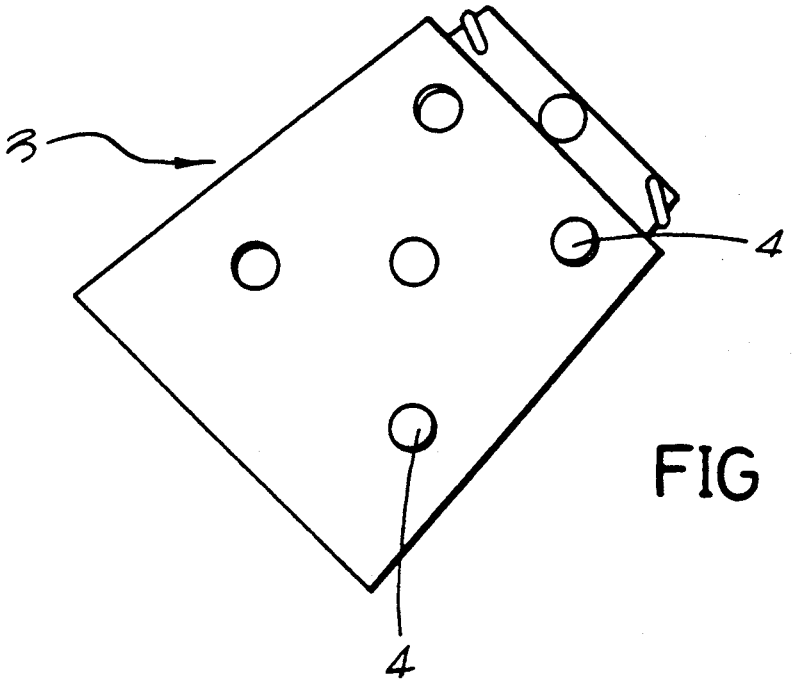

Reference is now made to FIGS. 1 to 5. These figures show an air diffuser comprising a diffuser head 1, a first diffuser neck 2, and a second diffuser neck 3. The diffuser necks 2, 3 are in the form of sleeves one end of which may be attached to the diffuser head 1 and the other end of which may be fitted over the barrel of a hairdryer (not shown). The first diffuser neck 2 has a tapering internal diameter so as to enable it to accommodate hairdryer barrels with outer dimensions between 36 mm and 56 mm. The second diffuser neck 3 is of generally larger dimensions than the first, so as to accomodate hairdryer barrels with dimensions between 72 mm and 54 mm.

The diffuser head 1 is disposed at an angle to the diffuser neck 2 or 3 and thus to the hairdryer barrel, so that the stream of hot air coming from the barrel is directed against the internal surface of the diffuser head 1 and is deflected out through the diffuser head mouth 1*a*. Because the diffuser head 1 is at an angle to the hairdryer barrel, the hairdryer is easier to manipulate.

The diffuser necks 2, 3 are each provided with air vents 4. As air is driven along the diffuser neck 2 or 3, substantially all of the air enters the diffuser head 1 and emerges through the diffuser mouth 1*a*. However, if a back pressure builds up in the diffuser neck 2 or 3, then some of the air will vent through the air vents 4. In certain circumstances, and for certain models of hairdryer, a partial vacuum may be created in the diffuser neck 2 or 3 and air at ambient temperature is then sucked into the diffuser neck 2 or 3. It will be appreciated that venting or sucking takes place only as required in response to a back pressure or a partial vacuum, and that generally speaking substantially all of the air from the hairdryer flows out through the diffuser mouth.

The diffuser necks 2, 3 are each provided with mutually parallel tapering bars 5, and mutually parallel air space pads 6. The bars 5 and pads 6 combine to firmly engage the diffuser neck 2 or 3 with the hairdryer barrel and to ensure that the air flowing along the diffuser neck is generally streamlined and free of turbulence. With regard to firm engagement, the hairdryer barrel is inserted into the diffuser neck 2 or 3 until the hairdryer barrel engages the rigid bars 5, and the barrel is held in this position by the resilient outward pressure of the compressed pads 6. With regard to the elimination of turbulence, the parallel bars 5 and pads 6 guide the airflow in laminar fashion along the length of the diffuser neck 2 or 3.

A further feature of the air diffuser is that it is provided with fingers 7 which may be used to comb the hair while drying the hair. The fingers 7 are each provided with air channels 7*a* to direct air onto the hair being combed.

Figure 6:
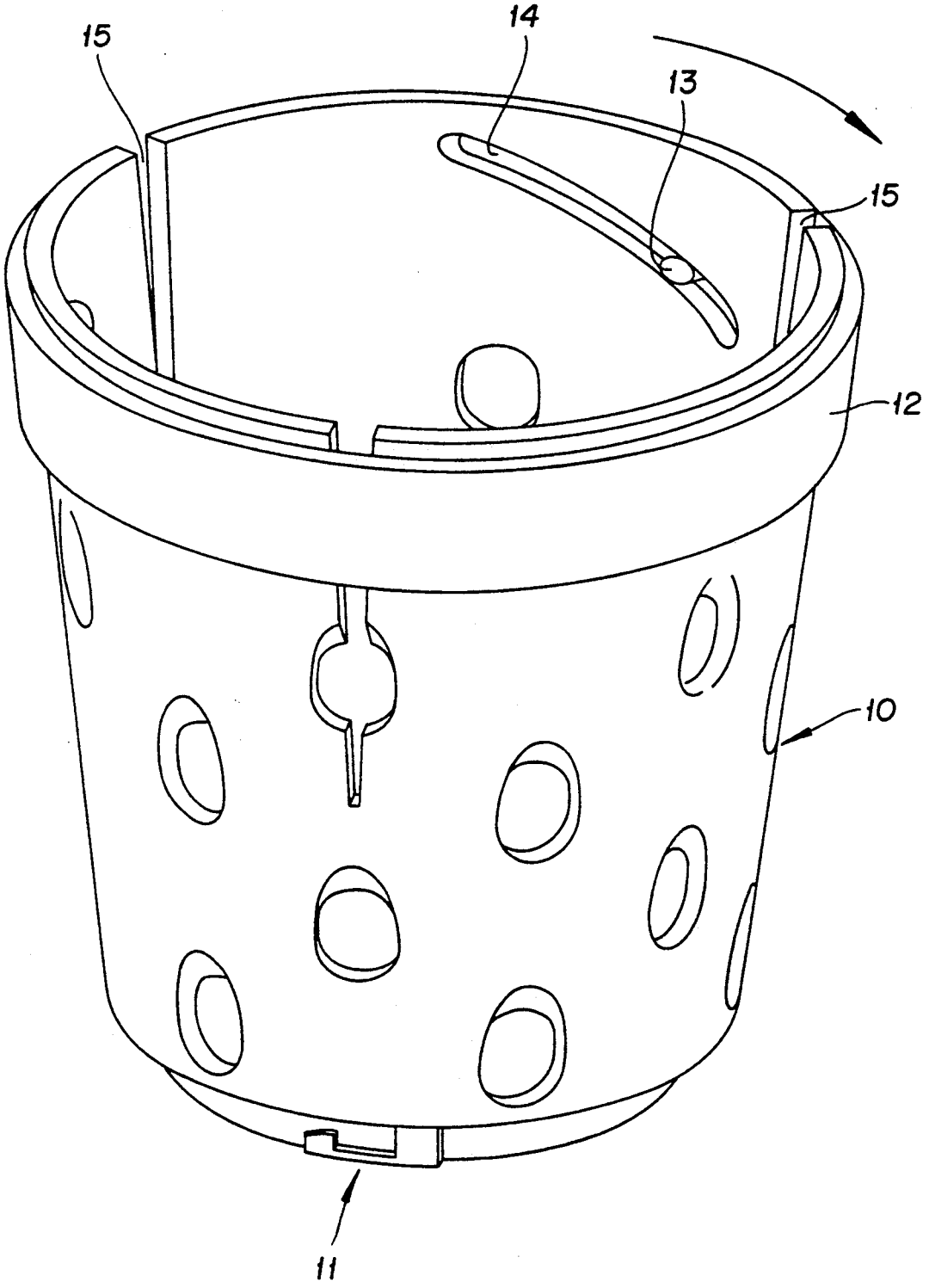
FIG. 6 is a perspective view of a second construction of diffuser neck.
Figure 9:
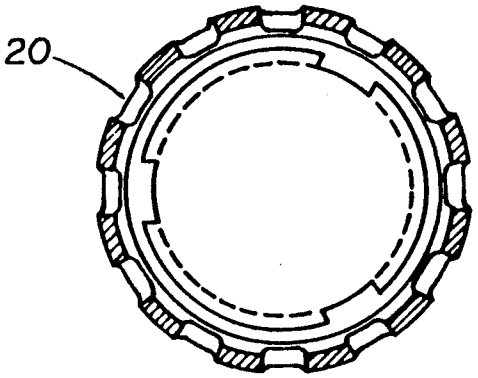
FIGS. 7 to 10 are various views of a third construction of diffuser neck.
Figure 8:
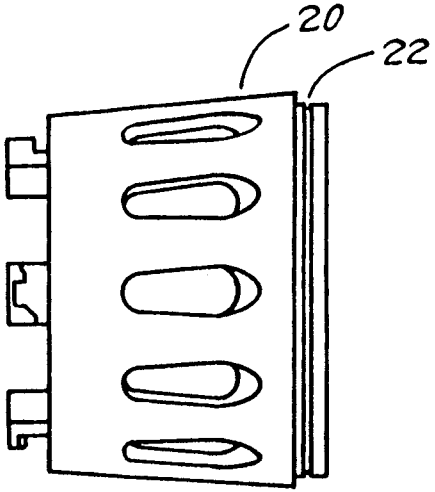
Figure 7:
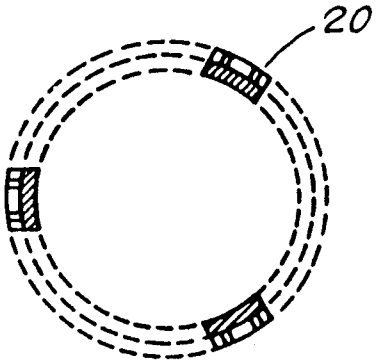
Figure 10:
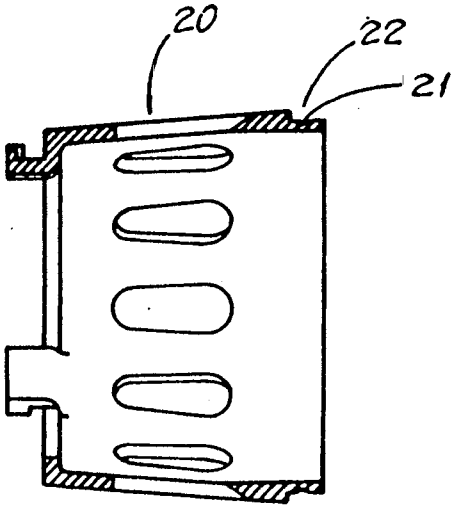

Referring now to FIG. 6, there is shown a second construction of diffuser neck 10. The diameter of the diffuser neck 10 tapers from the upper end to the lower end as seen in the drawing. The lower end of the diffuser neck 10 is of fixed diameter and is intended for connection to a diffuser head which is not shown in the drawings, and the diffuser neck includes engagement detents 11 for this purpose. The upper end of the diffuser neck 10 is of variable diameter to allow connection to hairdryers of a range of different barrel diameters. The diameter is varied by rotation of collar 12. As collar 12 is rotated in the direction shown by the arrow, complementary pins 13 on the collar and slots 14 in the diffuser neck 10 constrain the collar to upward movement thereby constricting the upper end of the diffuser neck. This constriction is possible because of the tapering vertical slots 15.

Referring now to FIGS. 7 to 10, there is shown a third construction of diffuser neck 20. This diffuser neck 20 is intended for use with a particular model of hair dryer (not shown) which is provided with an attachment means in the form of a circumferential rib just inside the mouth of the hairdryer barrel. The diffuser neck 20 is attached to the hairdryer barrel by inserting the wider end of the diffuser neck into the mouth of the hairdryer barrel and pushing the diffuser neck home until the groove 21 on the diffuser neck 20 mates with the rib in the mouth of the hairdryer barrel, and the shoulder 22 on the diffuser neck abuts the rim of the hairdryer barrel. This attachment mechanism allows the diffuser to be rotated relative to the hairdryer. The narrow end of the diffuser neck 20 is provided with attachment means for attaching the diffuser neck to a diffuser head (not shown).

I claim:

1. An air diffuser for attachment to a handheld hairdryer, comprising:

a diffuser neck which is tapered in a direction of air flow down the diffuser neck;

an angled diffuser head; and a plurality of air vents provided in the diffuser neck.

2. An air diffuser according to claim 1 further comprising means for adjusting a cross sectional dimension of said diffuser neck so as to enable the diffuser to be connected to hairdryers of different dimensions.

3. An air diffuser according to claim 2 wherein said adjusting means comprises:

a rigid rotatable collar having a pin; and a slot arranged on the diffuser neck to receive said pin so that as the collar is rotated it moves axially along the diffuser neck to constrict the diffuser neck.

4. An air diffuser according to claim 1 wherein the diffuser neck further comprises:

a shoulder for attaching the diffuser neck to a barrel of said hairdryer so that the shoulder abuts a rim of the barrel; and a circumferential groove on the shoulder for mating with a circumferential rib on said hairdryer.

* * * * *